US007335046B2

(12) United States Patent
Ju

(10) Patent No.: US 7,335,046 B2
(45) Date of Patent: Feb. 26, 2008

(54) ELECTRICAL CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/414,335

(22) Filed: May 1, 2006

(65) Prior Publication Data

US 2007/0254515 A1 Nov. 1, 2007

(51) Int. Cl.
*H01R 13/62* (2006.01)

(52) U.S. Cl. ..... 439/331; 439/296

(58) Field of Classification Search ..... 439/296, 439/296.331, 70

See application file for complete search history.

(56) References Cited

U.S. PATENT DOCUMENTS 3,582,865 A * 6/1971 Franck et al. ..... 439/67
5,423,687 A * 6/1995 Laub ..... 439/69
6,648,664 B1 * 11/2003 McHugh et al. ..... 439/331

* cited by examiner

*Primary Examiner*—Briggitte R. Hammond
(74) *Attorney, Agent, or Firm*—Troxell Law Office, PLLC

(57) ABSTRACT

An electrical connector is disclosed with a multipurpose clamping part, comprising an insulating body; a plurality of electrical terminals received in the insulating body; and a clamping part to clamp a chip module. The clamping part comprises a clamping portion connected to the insulating body and a conductive connection portion bending from one end of the clamping part thereunder. Compared to the conventional prior art, the clamping part of the electrical connector according to the present invention can not only effectively clamp a chip module, but also provide shielding to obtain better signal transmission effect for the electrical connector.

16 Claims, 5 Drawing Sheets

ELECTRICAL CONNECTOR

FIELD OF THE INVENTION

The present invention relates to an electrical connector, and more particular, to an electrical connector with a clamping part which can not only effectively clamp a chip module, but also provide shielding to obtain better signal transmission effect for the electrical connector.

BACKGROUND OF THE INVENTION

A conventional electrical connector comprises a main body, a plurality of electrical terminals received in the main body, and clamping a part to clamp chip modules, wherein the clamping part is generally pivotedly connected to one end of the main body. The center of the main body is provided with a through hole whose two edges extend inwards to form a clamping portion of arc cross-section. When the clamping part is being turned to fasten, the clamping portion of the clamping part will abut against the chip module. Furthermore, to obtain better signal transmission effect, a shielding device is usually provided on the electrical connector. The grounding device and the clamping part are usually formed separately, leading to a complex and thus inefficient manufacturing process.

Consequently, it is necessary to design a new electrical connector to overcome the drawbacks described above.

SUMMARY OF THE INVENTION

An object of the present invention is to provide an electrical connector with a clamping part which can not only effectively clamp a chip module, but also provide shielding to obtain better signal transmission effect for the electrical connector.

To achieve the object described above, the electrical connector comprises an insulating body; a plurality of electrical terminals received in the insulating body; and a clamping part to clamp a chip module. The clamping part further comprises a clamping portion connected to the insulating body and a conductive connection portion bending from one end of the clamping part thereunder.

Compared to the conventional prior art, the electrical connector according to the present invention has the advantages described below. The clamping part of the electrical connector can not only effectively clamp a chip module, but also provide shielding to obtain better signal transmission effect for the electrical connector.

BRIEF DESCRIPTION OF THE DRAWINGS

The present invention can be more fully understood by reference to the following description and accompanying drawings, in which.

DETAILED DESCRIPTION OF THE INVENTION

Figure 1:
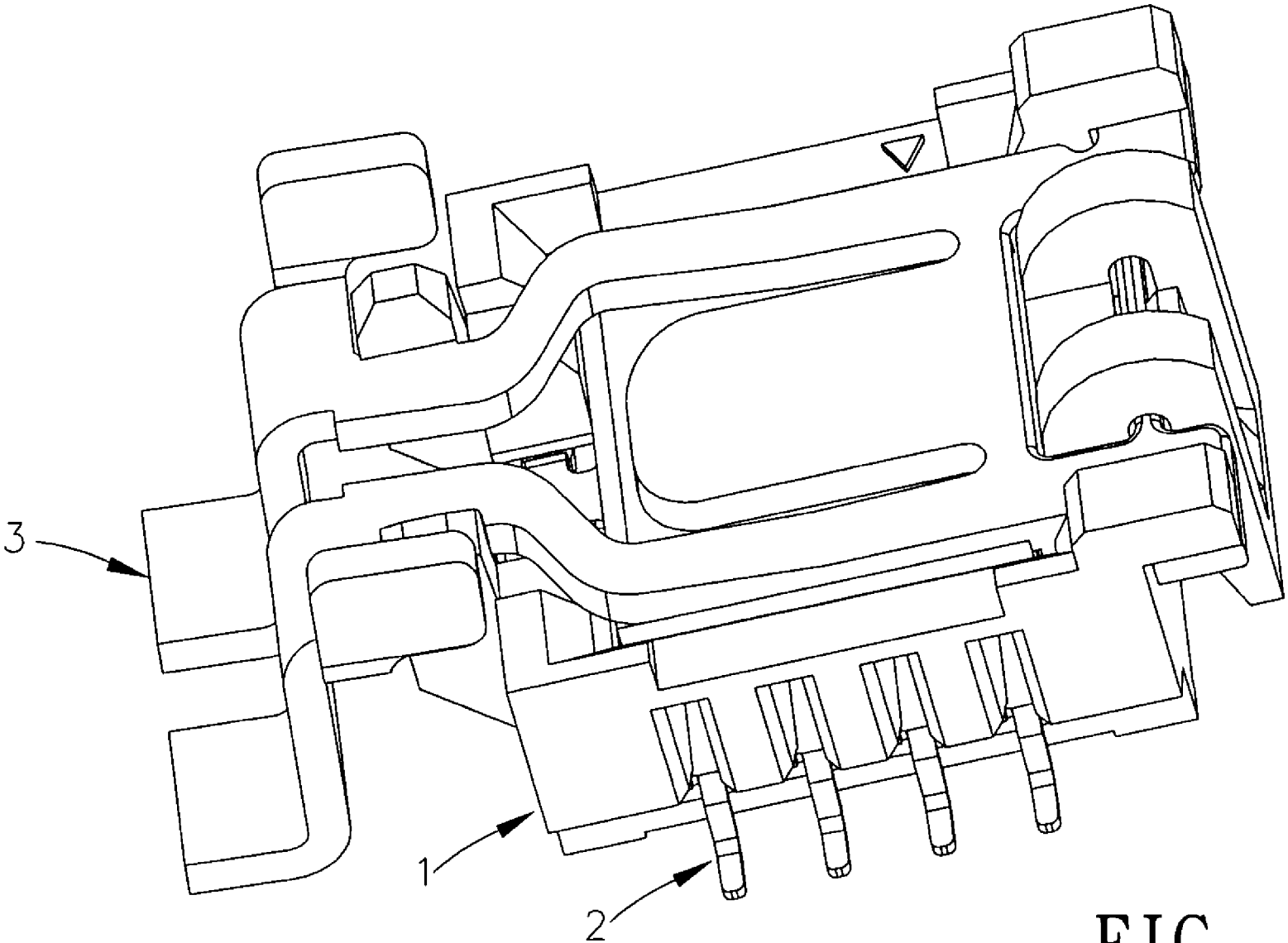
FIG. 1 schematically illustrates the perspective assembly view of a preferred embodiment of the electrical connector according to the present invention.
Figure 2:
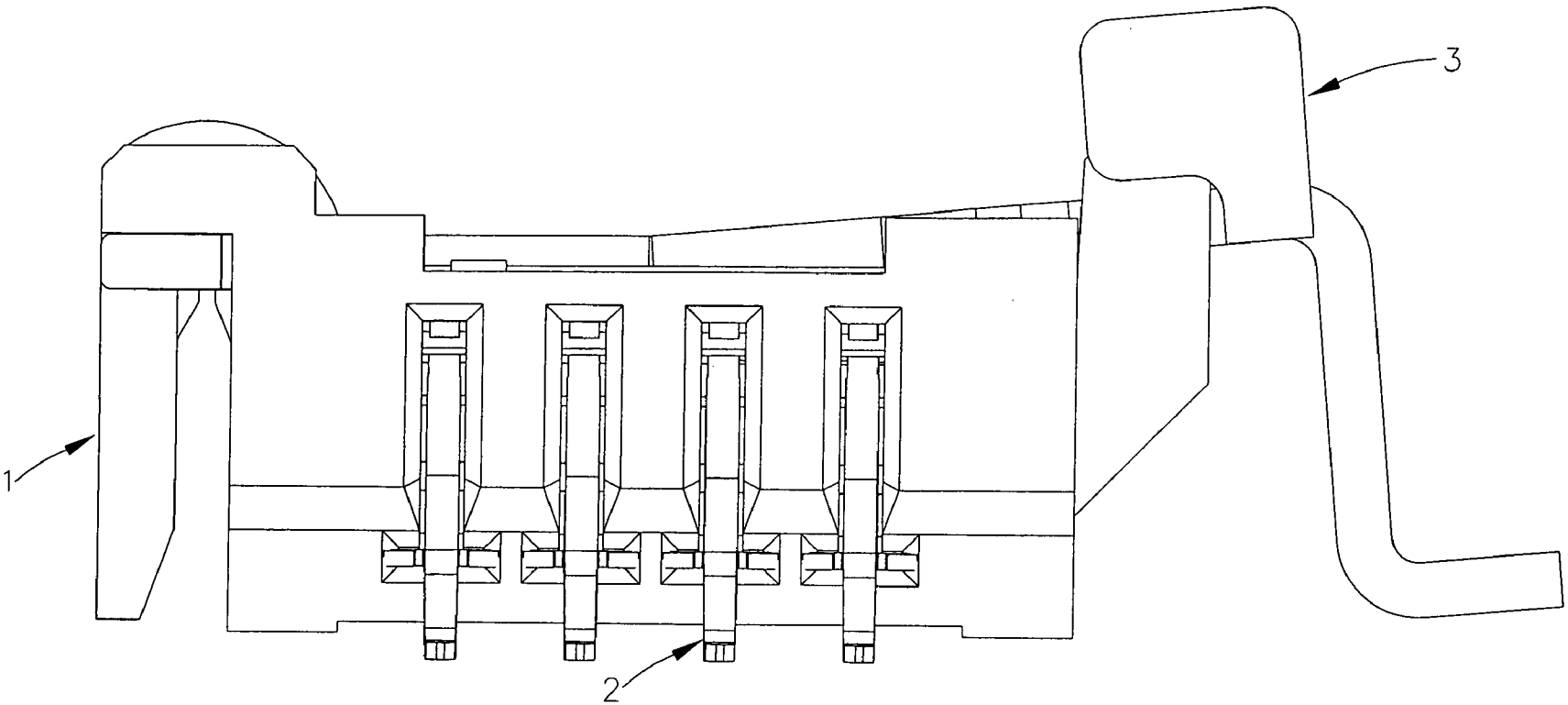
FIG. 2 schematically illustrates the front view of a preferred embodiment of the electrical connector according to the present invention.
Figure 3:
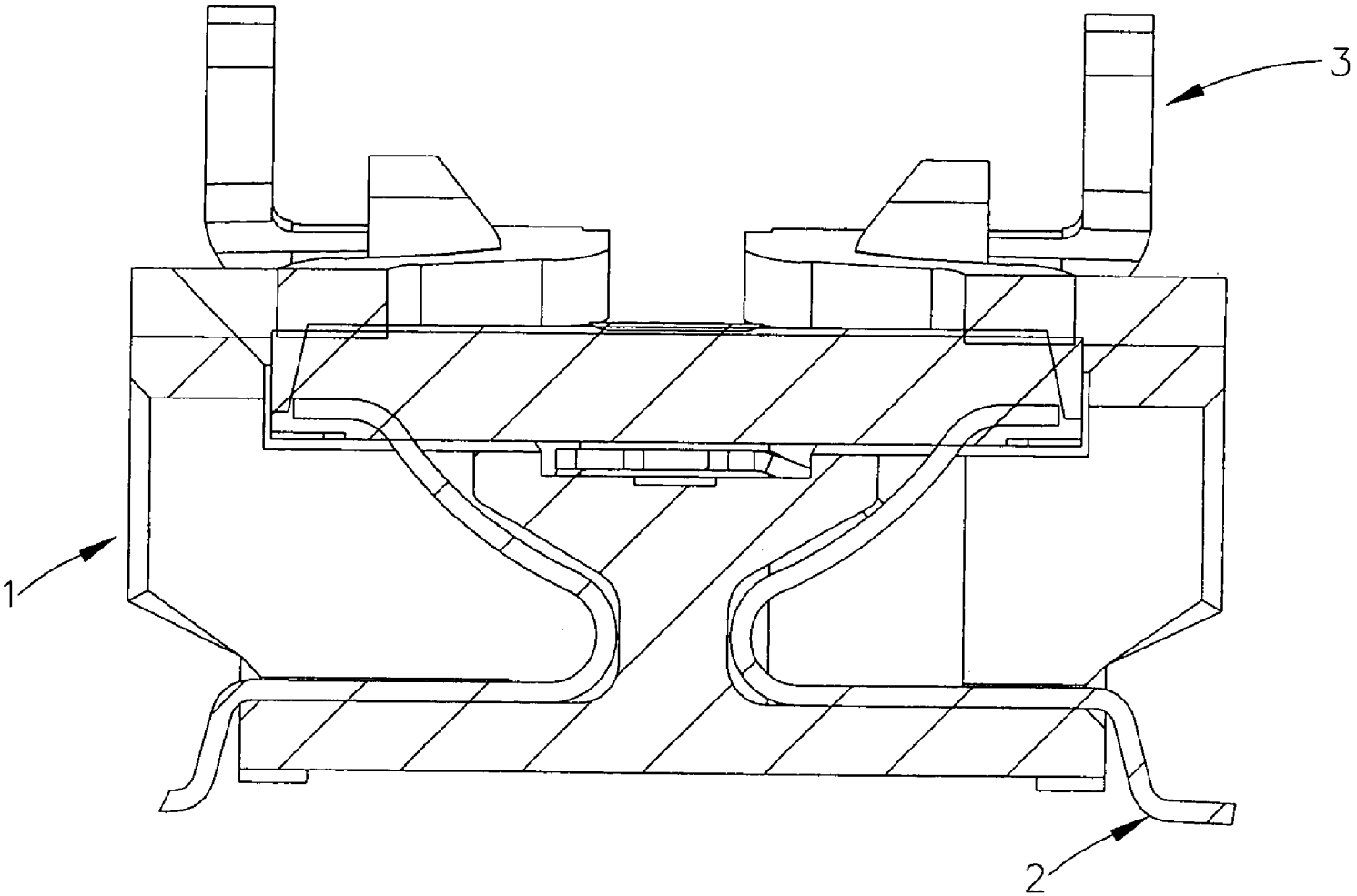
FIG. 3 schematically illustrates the cross-sectional view of a preferred embodiment of the electrical connector according to the present invention.
Figure 4:
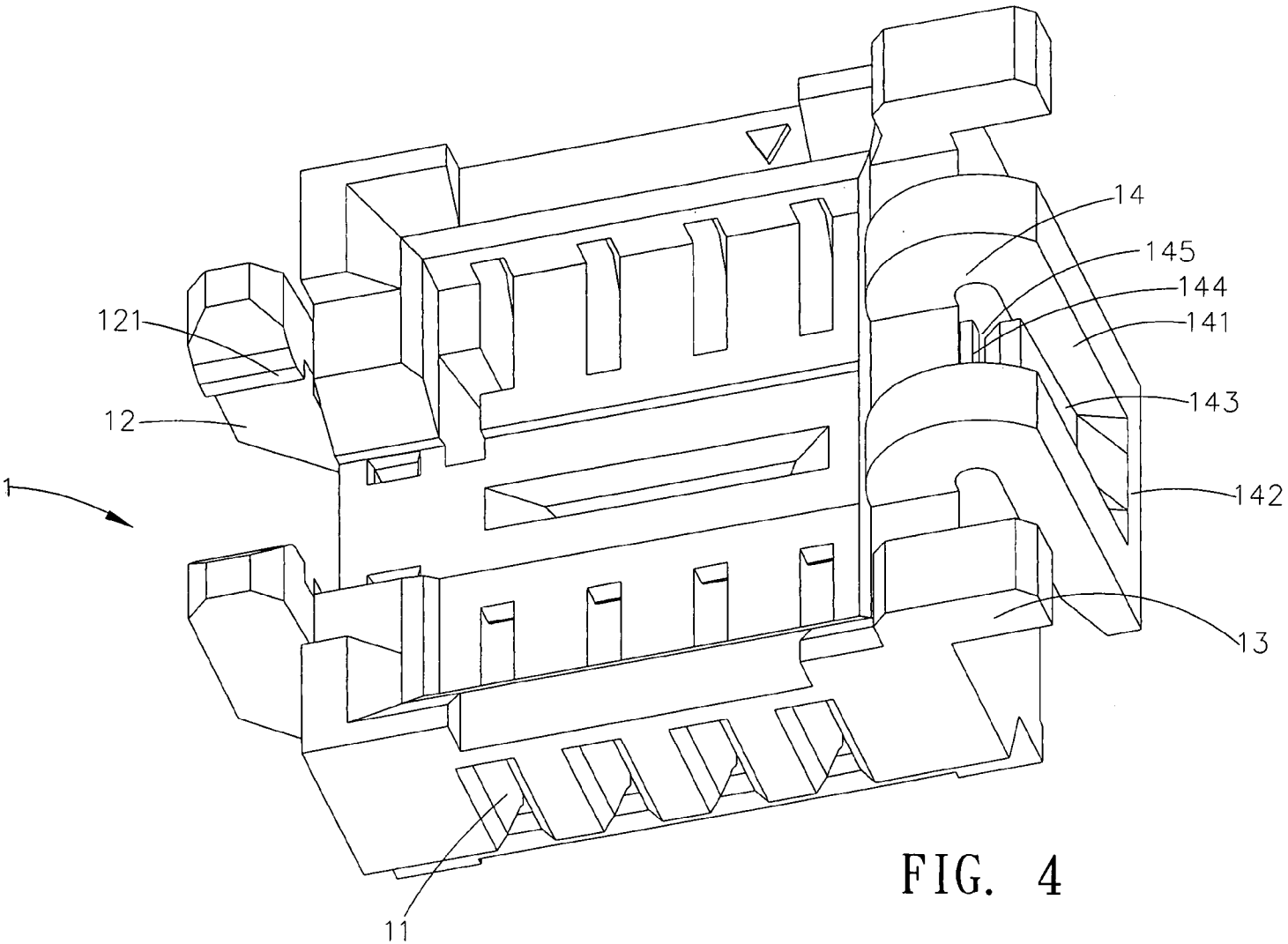
FIG. 4 schematically illustrates the perspective view of the insulating body according to the present invention.
Figure 5:
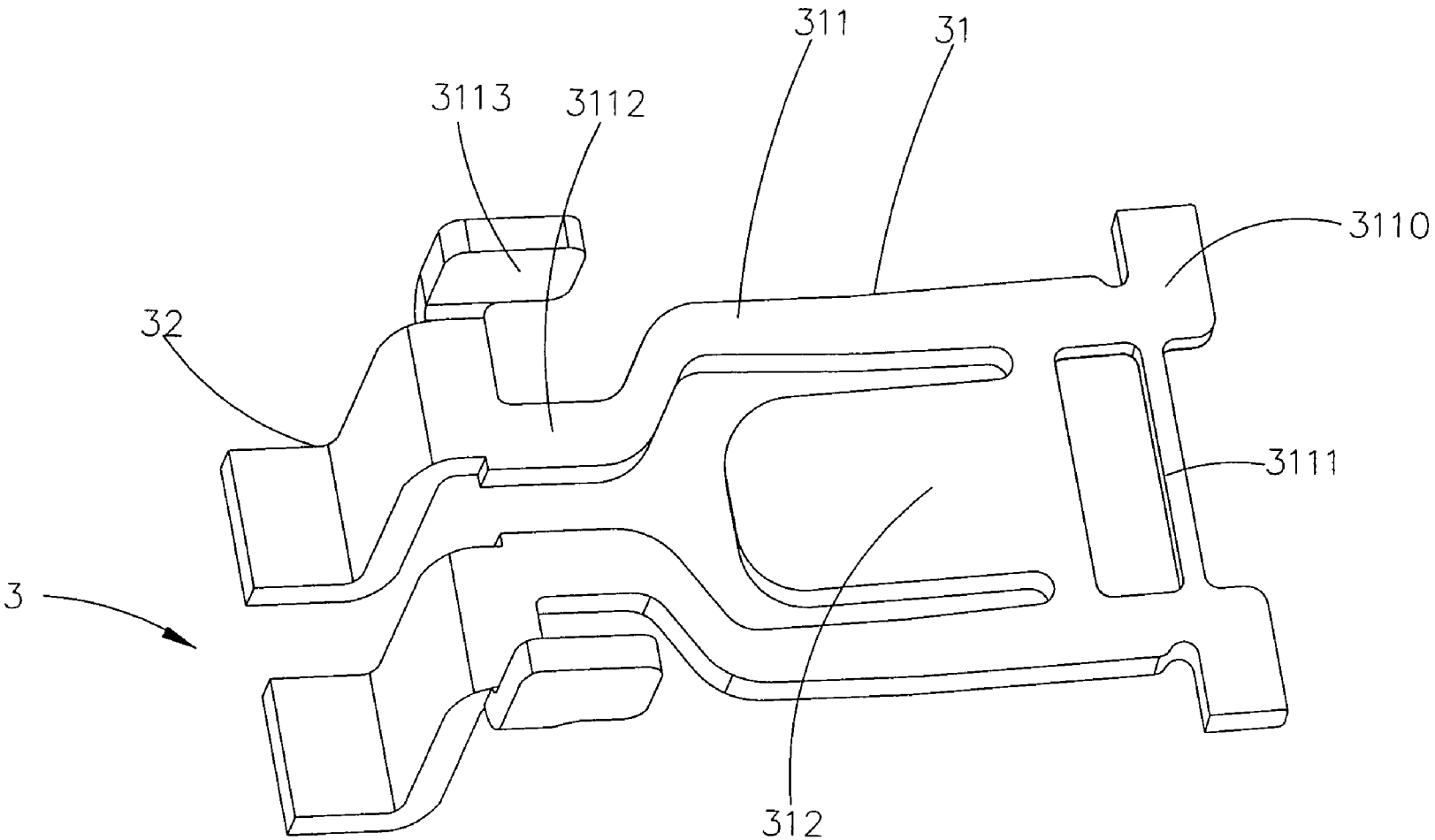
FIG. 5 schematically illustrates the perspective view of the clamping part according to the present invention.

Referring to FIGS. 1 to 5, the electrical connector according to the present invention comprises an insulating body 1 provided with a plurality of receiving chambers 11; a plurality of electrical terminals 2 received in the insulating body 1, and a clamping part 3 to clamp a chip module.

Both sides of the central insulating body 1 are symmetrically provided with a plurality of receiving chambers 11 to receive the electrical terminals 2. One end of the insulating body 1 protrudes outwards to symmetrically form a first protruding block 12 whose top protrudes inwards to form a fastening hook 121. Both sides of the opposite end of the insulating body 1 protrude outwards to symmetrically form a second protruding block 13. In the middle of this end of the insulating body 1, a fastening hook portion 14 is provided adjacent to the second protruding portion 13. The fastening hook portion 14 is, for example but not limited to, an arc shape. Furthermore, the end of the fastening hook portion 14 vertically extends downwards to form two vertical portions 141 connected by a level portion 142 between them. The center of the level portion 142 bends and extends upwards to form an elastic bar 143. A protruding bar 144 is provided in the middle of one side of the insulating body 1 corresponding to the elastic bar 143. A gap 145 is provided between the elastic bar 143 and the protruding bar 144.

The clamping part 3 comprises a clamping portion 31 and a conductive connection part 32, preferably a guiding connection part, wherein the clamping portion 31 is connected to the insulating body 1 and is provided with at least an elastic arm 311 (In the present embodiment, for example but not limited to, two elastic arms 311 are separately provided for explanation). One side of the elastic arm 311 extends to form a stop portion 3110, which is connected by an axial portion 3111. The other side of the elastic arm 311 extends to form a fastening portion 3112, which bends upwards and extends to form a pulling portion 3113, perpendicular to the fastening portion 3112. The clamping portion 31 is further provided with a sucking portion 312 (In the present embodiment, the sucking portion 312 is, for example but not limited to, provided between the elastic arms 311.), which is a flat surface. The guiding connection portion 312 has a L-shape cross section (may be a line-shape of course) and is formed by extending downwards from the end of the fastening hook 3112 which is used for grounding.

When the electrical connector is being assembled, the axial portion 3111 is first passed through the gap 145 to engage to the area between the protruding bar 144 and the upper end of the elastic bar 143 as well as engage to the lower part of the fastening hook portion 14. Then, the clamping part 3 is turned to render the stop block 321 stop at and abut against the lower part of the second protruding block 13. The fastening portion 3112 of the clamping part 3 is retained by the first fastening hook 121. Accordingly, the clamping part 3 can be fastened onto the insulating body 1. When the electrical connector is installed onto a circuit board (not shown), the conductive connection portion 32 can be conductively connected with the circuit board. Consequently, the clamping part 3 has a clamping function as well as a shielding effect.

Consequently, an electrical connector according to the present invention includes a clamping part, which can not only effectively clamp chip modules, but also provide shielding to obtain better signal transmission effect for the electrical connector. It can indeed overcome the shortcomings of the conventional prior art of electrical connectors.

While the invention has been described with reference to the a preferred embodiment thereof, it is to be understood that modifications or variations may be easily made without departing from the spirit of this invention, which is defined by the appended claims.

What is claimed is:

1. An electrical connector, comprising:

an insulating body provided with at least one receiving chamber;

at least an electrical terminals received in the insulating body; and a clamping part to clamp a chip module, including a clamping portion connected to the insulating body and a conductive connection portion bending from one end of the clamping part, wherein the clamping portion is provided with two elastic arms, which bend downwards to form two conductive connection portions, wherein the two conductive connection portions are guiding connection portions.

2. The electrical connector as defined in claim 1, wherein the two conductive connection portions are separately.

3. The electrical connector as defined in claim 1, wherein two stop portions are connected by an axial portion between them.

4. The electrical connector as defined in claim 1, wherein one end of the elastic arm is extendingly provided with a stop portion.

5. The electrical connector as defined in claim 4, wherein two stop portions are connected by an axial portion between them.

6. The electrical connector as defined in claim 1, wherein one end of the elastic arm is extendingly provided with fastening portion.

7. The electrical connector as defined in claim 6, wherein the fastening portion bends upwards to form a pulling portion.

8. The electrical connector as defined in claim 1, wherein one end of the elastic arm is extendingly provided with fastening portion.

9. The electrical connector as defined in claim 8, wherein the fastening portion bends upwards to form a pulling portion.

10. The electrical connector as defined in claim 1, wherein the clamping portion is further provided with a sucking portion.

11. The electrical connector as defined in claim 10, wherein the sucking portion is further provided with a flat surface.

12. The electrical connector as defined in claim 1, wherein one end of the insulating body protrudes outwards to symmetrically form a first protruding block, whose top protrudes inwards to form a fastening hook.

13. The electrical connector as defined in claim 12, wherein both ends of one side of the insulating body protrude outwards to symmetrically form a second protruding block and a fastening hook portion is provided adjacent to the second protruding portion in the middle of the side of the insulating body.

14. The electrical connector as defined in claim 13, wherein fastening hook portion is an arc shape.

15. The electrical connector as defined in claim 13, wherein the end of the fastening hook portion vertically extends downwards to form two vertical portions connected by a level portion between them and the center of the level portion bends and extends upwards to form an elastic bar.

16. The electrical connector as defined in claim 15, wherein a protruding bar is provided in the middle of one side of the insulating body corresponding to the elastic bar and a gap is provided between the elastic bar and the protruding bar.

* * * * *